United States Patent [19]

Wehl

[11] 4,445,105

[45] Apr. 24, 1984

[54] THERMOSTAT

[75] Inventor: Glenn E. Wehl, North Canton, Ohio

[73] Assignee: Portage Electric Products, Inc., North Canton, Ohio

[21] Appl. No.: 392,527

[22] Filed: Jun. 28, 1982

[51] Int. Cl.[3] ..... H01H 61/08

[52] U.S. Cl. ..... 337/94; 337/349; 337/370

[58] Field of Search ..... 337/57, 67, 89, 94, 337/347, 349, 368, 370, 371

[56] References Cited

U.S. PATENT DOCUMENTS

| | | | |
|---|---|---|---|
| 1,506,769 | 9/1924 | Newell | 337/370 |
| 1,916,669 | 7/1933 | Kuhn et al. | 337/371 |
| 2,058,390 | 10/1936 | Alban et al. | 337/370 |
| 2,944,324 | 7/1960 | Moyer | 337/380 X |
| 3,066,206 | 11/1962 | Dales | 337/379 X |
| 3,577,111 | 5/1971 | Nardulli | 337/372 X |
| 3,721,934 | 3/1973 | Wells | 337/380 |

*Primary Examiner*—George Harris

*Attorney, Agent, or Firm*—McAulay, Fields, Fisher, Goldstein & Nissen

[57] ABSTRACT

A thermostat, operating on the basis of current generated heat, rather than ambient temperature, operates as an equivalent of a snap-action thermostat, though without the necessity for provision of a snap-action dimple, by use of two bimetallic arms, the motion of one being restricted by the casing and a calibration dimple in or on the casing. The two bimetallic arms move, as in a creep action thermostat, upon current generation, with separation of the arms being accomplished when the restricted arm can no longer move to follow the unrestricted arm. Such thermostats are particularly valuable where a high initial inrush of current is experienced, as with an incandescent lamp fixture, when initial opening of the device, on the high current inrush, is not desired.

7 Claims, 4 Drawing Figures

THERMOSTAT

BACKGROUND OF THE INVENTION

It has long been known in the thermostat art that creep action is to be avoided. The primary reason for the avoiding of creep action has been to prevent damage to the contacts caused by arcing as the contacts just begin to separate, and to prevent other undue wear on these contacts caused by arcing and chattering.

A solution adopted by the prior art to avoid creep action has been the use of the snap-action thermostat. In particular, this is accomplished by the formation of a dimple in a bimetallic member, the dimple snapping from a convex to a concave, or concave to convex, shape when the preset temperature is reached. This snapping of the dimple causes a rapid movement of the bimetallic arm in which the dimple is formed, resulting in a sudden separation of the two contacts in the thermostat. Thus, creep is avoided.

The use of snap-action thermostats, as described, however is not entirely free from problems. In particular, thermostats formed with snap-action members are about twice as expensive as those formed with creep action members. Further, when formed in automatic assembly equipment, as an extremely large number of thermostats are today, there is a substantial loss of thermostats employing the snap-action, dimpled bimetallic arms. Frequently, as many as 50% of the snap-action arms are lost in testing following formation; by comparison, there is generally about a 96% yield of creep action type thermostats.

Attempts have been made by the industry to obtain the benefit of the snap-action type of system, desired for its operation and equipment wear, while utilizing, essentially, a creep action type of thermostat. In general, however, these have been hybrid systems, such as shown in U.S. Pat. Nos. 3,789,339, 3,851,288, and particularly 4,319,214, all assigned to the assignee of the present invention. While each of these thermostats provides an adequate solution for the problems it is to solve, it does not really provide for a thermostat giving the benefits of snap action, while avoiding the costs and assembly losses experienced with that type of thermostat.

In addition, recently, an increased emphasis has been placed on thermal protectors for incandescent light fixtures. Because of the nature of the service, there is a high initial inrush of current, as the incandescent fixture is illuminated, followed, quite rapidly, by a substantial drop in current. If the thermostat employed is not able to accept this initial surge without breaking the circuit, it is difficult, if not impossible, to illuminate the incandescent fixture. Accordingly, the industry has also sought a thermostat for an incandescent fixture which will accommodate the high initial current surges without breaking the electric circuit, while still providing sufficient protection to interrupt the circuit should problems develop during regular operation of the incandescent fixture.

BRIEF DESCRIPTION OF THE INVENTION

In accordance with the present invention, two bimetallic arms are mounted within a thermostat casing, each of the arms having mounted thereto a contact, the two contacts mating to complete the circuit. One of the bimetallic arms is, essentially, simply cantilever mounted from the insulation in the open end of the casing, and bends about that insulation.

In accordance with the present invention, the second bimetallic arm, which, preferably, has a higher electrical resistance than the first bimetallic arm, while also cantilever supported from the insulation at the open end of the thermostat, is restricted from movement because it is biased against the thermostat casing and, additionally, bears against a calibration dimple formed in or on the casing. This dimple acts as a fulcrum and prevents free movement of the second bimetallic element, except about the fulcrum.

Thus, the only portion of the second bimetallic arm which moves, upon heating, is the free end of that arm on the opposite side of the fulcrum from the cantilever support. This second arm is preferably formed of a higher resistance material than the first bimetallic arm, so that upon high current loads, it tends to heat and move faster. Because of the restriction of its motion, it is able to continue to mate with the first bimetallic arm for only a portion of its travel. When the second arm is no longer able to follow the first arm, operation of the device is similar to a standard device, except that motion of the second bimetallic arm is prevented, so that there is, in effect, a snap action separation of the two contacts.

As indicated, the thermostat device of the present invention is particularly useful for incandescent light fixtures. However, it may also be used in other areas where thermostats have been employed in the past, such as in motors, electrical appliances, and the like.

BRIEF DESCRIPTION OF THE DRAWNGS

DESCRIPTION OF THE PREFERRED EMBODIMENTS

Figure 1:
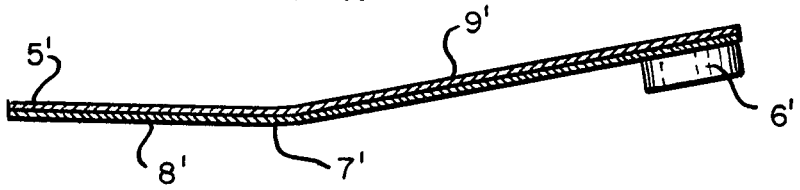
FIG. 1 is a sectional view of a bimetallic arm, said arm being bent for biasing in a particular direction.
Figure 2:
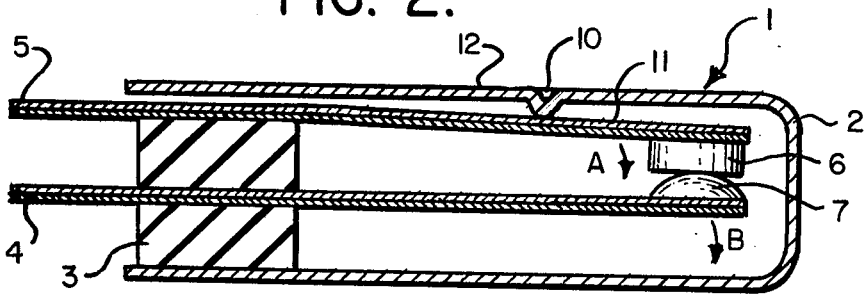
FIG. 2 is a sectional view of a thermostat in accordance with the present invention, employing the bimetallic arm of FIG. 1, said thermostat being in a closed, operative position.

In accordance with the present invention, and referring, particularly, to FIGS. 1 and 2, a thermostat 1 is illustrated having a casing 2 with an open end and a closed end, and an insulating support member 3 mounted in the open end of the casing. Mounted by the insulating support member 3 are a first bimetallic arm 4 and a second bimetallic arm 5.

The materials of construction of the bimetallic arms 4 and 5 are the standards employed in the art. While the two bimetallic arms may have, essentially, the same electrical resistance, it is preferable that the second bimetallic arm 5 have an electrical resistance at least twice the resistance of the first arm 4. The second bimetallic arm 5, in addition to or instead of the increased electrical resistance, may be formed of materials to provide a higher deflection rate during the passage of electrical current than the deflection rate demonstrated by the bimetallic arm 4. Bimetallic arm 5 is provided with a movable contact 6, while bimetallic arm 4 is provided with a movable contact 7, the contacts 6 and 7 being in electrical contact, as illustrated in FIG. 2, to complete an electrical circuit, now shown.

For proper operation of the device, it is important that the bimetallic arm 5 be biased toward the casing wall, such as toward the top 12 of casing 2. One means to accomplish this is to form the bimetallic arm 5 in the manner shown in FIG. 1. Here, employing prime numbers, the bimetallic arm 5' with the movable contact 6' is bent at the center, as shown at 7', to provide a left portion 8', and a right portion 9'. When the bimetallic arm 5' is inserted into the casing 2, the portion adjacent the insulating member 3 being, essentially, parallel to the upper portion of the casing 12, the end 9' is forced upwardly, with substantial pressure, against the top 12. Depending upon the degree of the bend 7', the bend may actually not be apparent within the casing 2.

In order to provide proper calibration of the thermostat in accordance with the present invention, as well as to provide a fulcrum, substantially separated from the insulating member 3, a calibration dimple 10 is formed in the upper portion 12 of casing 2 to bear against bimetal member 5. This placement of the calibration dimple 10 is one of the means of making certain that the bias of the bimetal member 5 is toward the casing wall and, if the bimetal 5 employed is in the form 5' illustrated in FIG. 1, may act to remove the bend 7' from the bimetal 5' as it is employed in the thermostatic device 1. Though the thermostat 1 is illustrated with a dimple 10 formed in the top 12 of the case, it should be apparent that, if desired, the calibration dimple can be preformed on the casing, as by use of a dot of solder, or other means, formed on the inside of the casing.

Figure 3:
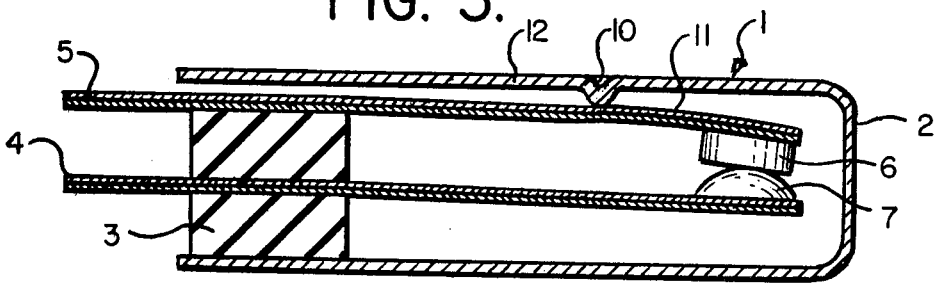
FIG. 3 is a view similar to FIG. 2, the bimetallic arms being slightly bent, but maintaining contact, so as to continue completion of an electrical circuit associated with said thermostat.

Because the bimetal 5 is prevented from bending, except for the free end 11, beyond the fulcrum 10, upon initial current passage through the device, movement of movable contact 6, according to arrow A, is approximately the same as the movement of movable contact 7, in accordance with arrow B. Because of this, contact is maintained between contacts 6 and 7, without interruption of the electrical circuit and without arcing between the two movable contacts. This relatively equal movement of the movable contacts 6 and 7 is maintained for a portion of the travel of the movable contacts 6 and 7, as illustrated in FIG. 3.

This approximately equal movement of movable contacts 6 and 7 upon some current passage is particularly important when the thermostat of the present invention is employed as a circuit protector on an incandescent fixture. When an incandescent fixture is first illuminated, there is a high rush of current approximately 15 times the rated current for a few milliseconds. With a standard current activated thermostat, this would cause, particularly in the case of a snap action device, snapping of a bimetal arm, and, in any event, separation of the contact. In such a situation, since the current would immediately drop, the contact would reconnect, and there would be a rapid connection and disconnection of the contacts resulting in damage to the contacts through arcing and mechanical pressure, as well as a blinking of the incandescent fixture which is being illuminated. Because of the biasing of the second bimetallic element toward the wall of the casing, with only a portion of it free to move, this initial surge of current does not cause a separation of the contacts with the structure of the present invention.

When the second bimetallic arm 5 is formed with an electrical resistance at least twice that of the first bimetallic arm 4, or the second bimetallic arm has a rate of deflection different from that of the first bimetallic arm, with or without a higher electrical resistance, the contacts 6 and 7 are kept together during initial surge current with an even great effect than is caused by the structure. Because of the relative resistances, the bimetal 5 heats instantaneously much more rapidly than the bimetal 4, causing a more rapid movement of the free end 11 of that bimetal, so as to maintain it in contact with movable contact 7 of bimetal 4. This relative movement between the free end 11 of bimetal 5 and the movement of bimetal 4 is also maintained on increasing ambient temperatures.

Figure 4:
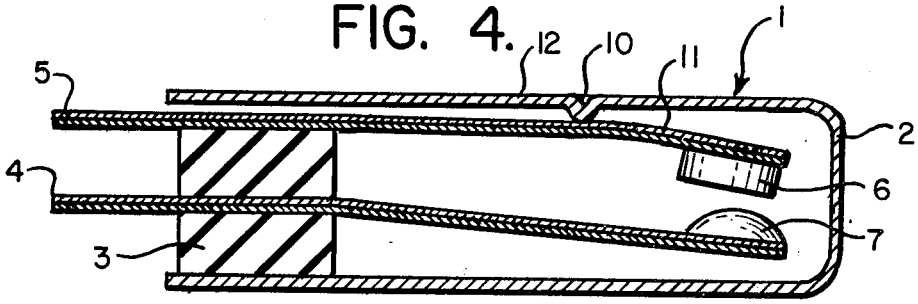
FIG. 4 is a view similar to FIG. 2, showing the contacts separated, so as to interrupt an associated electrical circuit.

If continued current flow through the thermostat 1 is excessive, indicative of some problem in the device being monitored, then the current flow continues to heat the bimetal arms 4 and 5 and to cause continued bending. Because bimetal 5 is free to bend only in section 11, even when it has a faster rate of heating, it is prevented from completely following bimetal 4, so that at the calibration point, movable contact 7 separates from movable contact 6, as illustrated in FIG. 4. Because of the relative degrees of movement between these two movable contacts, the effect is similar to one achieved with a snap action thermostat. In particular, with the structure of the present invention, positive contact closing and opening is achieved, along with a differential between the opening and closing temperatures of the contacts 6 and 7.

The action of the bimetallic arms in closing, in accordance with the structure of the present invention, is also important. As previously indicated, the relative position of the contacts 6 and 7 is shown in FIG. 4. Obviously, when the contact is broken, as illustrated in FIG. 4, the thermostat begins to cool. Because of the construction of the thermostatic device, particularly when bimetal 5 has a higher resistance and/or a different rate of deflection than bimetal arm 4, bimetal arm 5 begins to return to its original position at a rate slower than bimetallic arm 4. These relative rates of return to the original position continue until bimetallic arm 4 "catches up" with bimetallic arm 5. This "catch up" is due to the different active lengths of the two bimetallic arms 4 and 5, and may be enhanced by the different resistances and rates of bending. Upon "catch up," the contacts 6 and 7 are again in a mating relationship and the circuit is re-established.

The materials employed for casing 2 and insulating member 3 are standard in the art, and may be easily selected by those skilled in the art. The present invention is particularly directed to the biasing of the bimetal 5 toward the casing wall, preferably when that bimetal has a higher electrical resistance than the bimetal 4, in combination with the fulcrum 10, preventing full, free movement of bimetal 5 on current flow. As previously indicated, the cost of the instant device is substantially less than that of a snap action device and a much higher yield is obtained on assembly.

While specific embodiments of the invention have been shown and described, this invlention should not be considered as limited to these embodiments, but only as limited by the appended claims.

I claim:

1. In a thermostatic device having a casing with an open end, a first bimetallic arm cantilever supported by an insulating member mounted in said open end of said casing, said first bimetallic arm having, at the end opposite the insulating member a first movable contact, and a second bimetallic arm supported by said insulating member and having, at the end opposite the insulating member a second movable contact, said first bimetallic arm and said second bimetallic arm being so formed as to provide, at appropriate temperatures, for electrical and mechanical contact between said movable contact members, the improvement which comprises biasing said second bimetallic arm toward a wall of said casing, and providing on the inner portion of said casing, intermediate the insulating member and the second movable contact, a fulcrum bearing against said second bimetallic arm, said second bimetallic arm being biased away from said first bimetallic arm.

2. The thermostatic device of claim 1 wherein said second bimetallic member is biased upwardly against a portion of the case of said thermostatic member.

3. The thermostatic device of claim 2 wherein said second bimetallic member is formed, prior to insertion into said casing, with a bent portion.

4. The thermostatic device of claim 1 wherein said fulcrum is in the form of a calibration dimple formed by indenting a wall of said casing.

5. The thermostatic device of claim 1 wherein said second bimetallic arm has an electrical resistance substantially higher than the electrical resistance of said first bimetallic arm.

6. The thermostatic device of claim 5 wherein the ratio of electrical resistances is at least 2:1.

7. The thermostatic device of claim 1 wherein the first bimetallic arm and the second bimetallic arm have a different rate of bending.

* * * * *